US010273867B2

(12) United States Patent
Duan et al.

(10) Patent No.: US 10,273,867 B2
(45) Date of Patent: Apr. 30, 2019

(54) PROGNOSTIC SYSTEM AND METHOD FOR AN ELECTRIC COOLANT PUMP

(71) Applicant: GM GLOBAL TECHNOLOGY OPERATIONS LLC, Detroit, MI (US)

(72) Inventors: Shiming Duan, Ann Arbor, MI (US); Christopher H. Knieper, Cheasaning, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 234 days.

(21) Appl. No.: 15/423,045

(22) Filed: Feb. 2, 2017

(65) Prior Publication Data

US 2018/0216517 A1 Aug. 2, 2018

(51) Int. Cl.

| | |
|---|---|
| ***F01P 5/12*** | (2006.01) |
| ***F01P 5/14*** | (2006.01) |
| ***F01P 7/16*** | (2006.01) |
| ***F01P 11/18*** | (2006.01) |

(52) U.S. Cl.

CPC ..... *F01P 5/12* (2013.01); *F01P 5/14* (2013.01); *F01P 7/164* (2013.01); *F01P 11/18* (2013.01); *F01P 7/16* (2013.01); *F01P 2005/125* (2013.01); *F01P 2025/32* (2013.01); *F01P 2025/60* (2013.01); *F01P 2031/00* (2013.01); *F01P 2031/18* (2013.01)

(58) Field of Classification Search

CPC ..... F01P 5/12; F01P 5/14; F01P 7/164; F01P 11/18

See application file for complete search history.

(56) References Cited

U.S. PATENT DOCUMENTS

| | | | | |
|---|---|---|---|---|
| 8,473,147 | B2 * | 6/2013 | Ghoneim | F02D 41/221 701/29.4 |
| 2002/0118447 | A1 * | 8/2002 | Hempstead | H01S 3/094003 359/341.33 |
| 2009/0107663 | A1 * | 4/2009 | Weber | F25B 23/006 165/288 |

FOREIGN PATENT DOCUMENTS

| | | | |
|---|---|---|---|
| CN | 101949322 | A | 1/2011 |
| CN | 102022172 | A | 4/2011 |
| CN | 104420970 | A | 3/2015 |
| CN | 106150661 | A | 11/2016 |
| CN | 106183714 | A1 | 12/2016 |
| CN | 205808464 | U | 12/2016 |

* cited by examiner

*Primary Examiner* — Kevin A Lathers
(74) *Attorney, Agent, or Firm* — Quinn IP Law

(57) ABSTRACT

A thermal management system includes an electric coolant pump, power source, and controller. The pump is in fluid communication with a heat source and a radiator, and has pump sensors for determining a pump voltage, speed, and current. The battery energizes the sensors. The controller receives the voltage, speed, and current from the sensors, determines a performance of the pump across multiple operating regions, calculates a numeric state of health (SOH) quantifying degradation severity for each of a plurality of pump characteristics across the regions, and executes a control action when the calculated numeric SOH for any region is less than a calibrated SOH threshold. The pump characteristics include pump circuit, leaking/clogging, bearing, and motor statuses. A vehicle includes an engine or other heat source, a radiator; and the thermal management system. The controller may execute a prognostic method for the electric coolant pump in the vehicle.

19 Claims, 2 Drawing Sheets

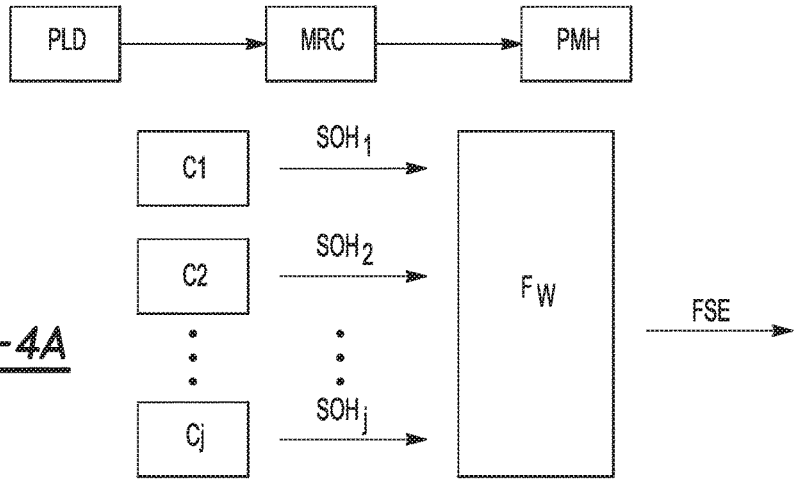
Fig-4A
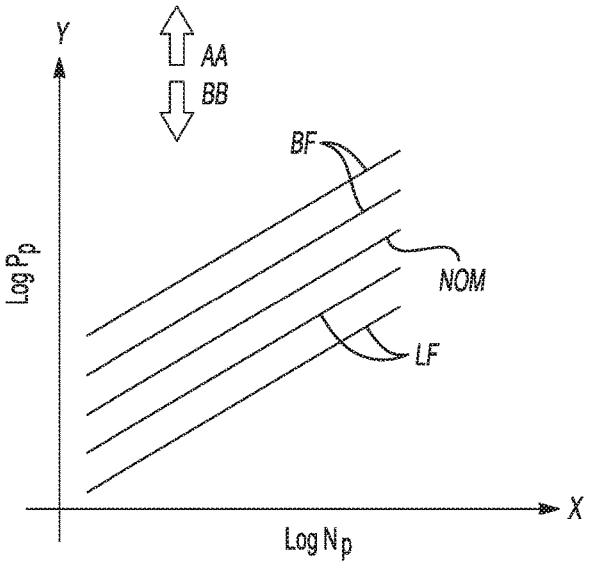
Fig-4B
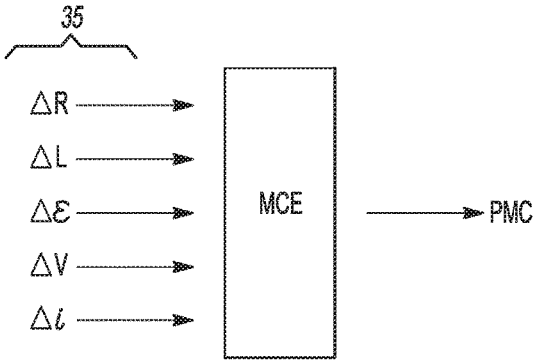
Fig-5
55
| CS | LS | BS | PMC | RES |
|---|---|---|---|---|
| F | * | * | * | $F_C$ |
| H | * | * | F | $F_M$ |
| H | F | F | H | INC |
| H | F | H | * | $F_L$ |
| H | H | F | H | $F_B$ |
Fig-6

PROGNOSTIC SYSTEM AND METHOD FOR AN ELECTRIC COOLANT PUMP

INTRODUCTION

Vehicles and other systems may employ an internal combustion engine as a torque-generating device. As internal combustion engines generate intense heat during operation, thermal management techniques are used to maintain engine temperature within a desired temperature range. Cooling of the engine and connected components may be achieved by circulating water, antifreeze, or another suitable coolant to a cylinder head and engine block of the engine where engine heat is extracted. The heated coolant is then fed into and cooled by a radiator assisted by ambient air and a cooling fan before re-entering the engine.

Coolant pumps, colloquially known as water pumps, are the particular pumping devices used to circulate coolant in a closed fluid conduit loop. Inside the pump, rotating impeller blades move the coolant through the pump body and out to the engine. Mechanical coolant pumps are typically driven at engine speed by a rotating belt and engine-driven pulleys. Alternatively, an electrically-driven coolant pump allows the rotational speed of a pump motor to be electrically controlled independently of engine speed, e.g., using temperature-based feedback control. Electric coolant pumps are thus able to eliminate parasitic power losses, improve fuel economy, and reduce component weight relative to mechanical engine-driven coolant pumps.

SUMMARY

A system and method are disclosed herein for performing a look-ahead prognosis of a thermal management system having an electric coolant pump. A non-limiting example embodiment of a top-level system that may benefit from the disclosed approach is a motor vehicle having an internal combustion engine. The methodology set forth herein is intended to facilitate estimation of a numeric state of health (SOH) of the thermal management system and its constituent components using available coolant pump sensor measurements. The pump thus acts as a "smart actuator" due to available closed-loop electrical feedback and sensor-based control signals, e.g., from a motor control processor resident within the coolant pump. The present approach, which can be implemented via an offboard and/or onboard controller in different embodiments, may be used to help identify and isolate developing system faults and quantify their relative severity before a hard failure has a chance to materialize.

An ongoing pump status mode diagnosed by the controllers may include a coolant flow rate. A low coolant flow rate may result from a coolant leak developed at the pump bearings or other mechanical elements of the coolant circuit, or a radiator pressure cap being open due to high operating temperatures and pressure, or due to underfill of coolant during installation or service. Over time, lower than expected coolant flow rates may cause overheating of the engine or connected system components, pump cavitation, and other potential problems. The present approach provides a way to capture certain nonlinearities and complexities of coolant flow, correlate electrical sensor signals from the coolant pump with developing failure modes, and account for performance variation across multiple different pump operating regions. This in turn allows the controllers to quantitatively estimate, in real time, the numeric SOH of the various thermal management system components and fuse the SOH data to thereby identify developing failure modes of the thermal management system.

In an example embodiment, a thermal management system is disclosed for cooling a heat source via a radiator. The thermal management system includes an electrically-driven coolant pump, a power source, and a controller. The coolant pump, which is in fluid communication with the radiator, has multiple sensors for measuring a voltage and electrical current draw of the coolant pump. The battery is electrically connected to the coolant pump and energizes the coolant pump and the sensors, i.e., the coolant pump is not engine-driven but rather is powered solely by electricity at a pump speed determined in real-time by the controller.

The controller in this particular embodiment is programmed to receive the measured voltage and current from the pump sensors, as well as a coolant temperature from a temperature sensor. The controller classifies performance of the coolant pump across multiple different pump operating regions, i.e., at different pump speeds, coolant temperatures, pump loads, etc., using the received voltage and current, and calculates a numeric SOH of the thermal management system for each pump operating region, such as a remaining percentage of health/remaining life or an integer representing a particular level of health.

The controller is also programmed to execute a control action with respect to the thermal management system prior to setting a diagnostic fault code indicative of an actual/hard failure, doing so when the numeric SOH for any given pump operating region is less than a calibrated SOH threshold for that region. In this manner, an operator of the thermal management system, such as an operator of a motor vehicle, is alerted to a developing failure mode well before the failure mode has a chance to materialize as an actual failure, thus allowing sufficient time to preemptively service the thermal management system. Example control actions may include communicating a text message to an operator of a vehicle and/or to the external controller indicating the numeric SOH and/or the associated fault mode, automatically scheduling maintenance of the thermal management system, or adjusting one or more control parameters of the coolant pump to account for the SOH of a particular component of the thermal management system.

A vehicle includes a heat source, a radiator, and the thermal management system summarized above.

A prognostic method is also disclosed for an electric coolant pump in a vehicle having an internal combustion engine, an electric coolant pump, and a radiator. In an example embodiment, the method includes receiving, via a controller, a measured voltage and current from a plurality of pump sensors of the coolant pump, and determining a level of performance of the coolant pump across multiple pump operating regions using the received voltage and current. The method includes calculating a numeric SOH of the thermal management system that quantifies a relative severity of degradation each of a plurality of pump characteristics across multiple pump operating regions. A control action is then executed when the calculated numeric SOH for any of the pump operating regions is less than a calibrated SOH threshold, with the pump characteristics including a pump circuit status, a pump leaking/clogging status, a pump bearing status, and a pump motor status as noted above.

The above features and advantages, and other features and advantages of the present disclosure, will be readily apparent from the following detailed description of the embodiment (s) and best mode(s) for carrying out the described invention when taken in connection with the accompanying drawings and appended claims.

BRIEF DESCRIPTION OF THE DRAWINGS

FIG. 4A is a schematic flow diagram describing a process of regional classification of component state of health via the process depicted in FIG. 3.

FIG. 4B is an example plot of nominal and failure-indicative performance traces on a logarithm scale, with the log of pump power depicted on the vertical axis and the log of pump speed depicted on the horizontal axis.

FIG. 5 is a schematic flow diagram describing pump motor health estimation as part of the process of FIG. 3.

FIG. 6 is an example lookup table depicting various possible fault conditions for the thermal management system of FIG. 1.

DETAILED DESCRIPTION

Figure 1:
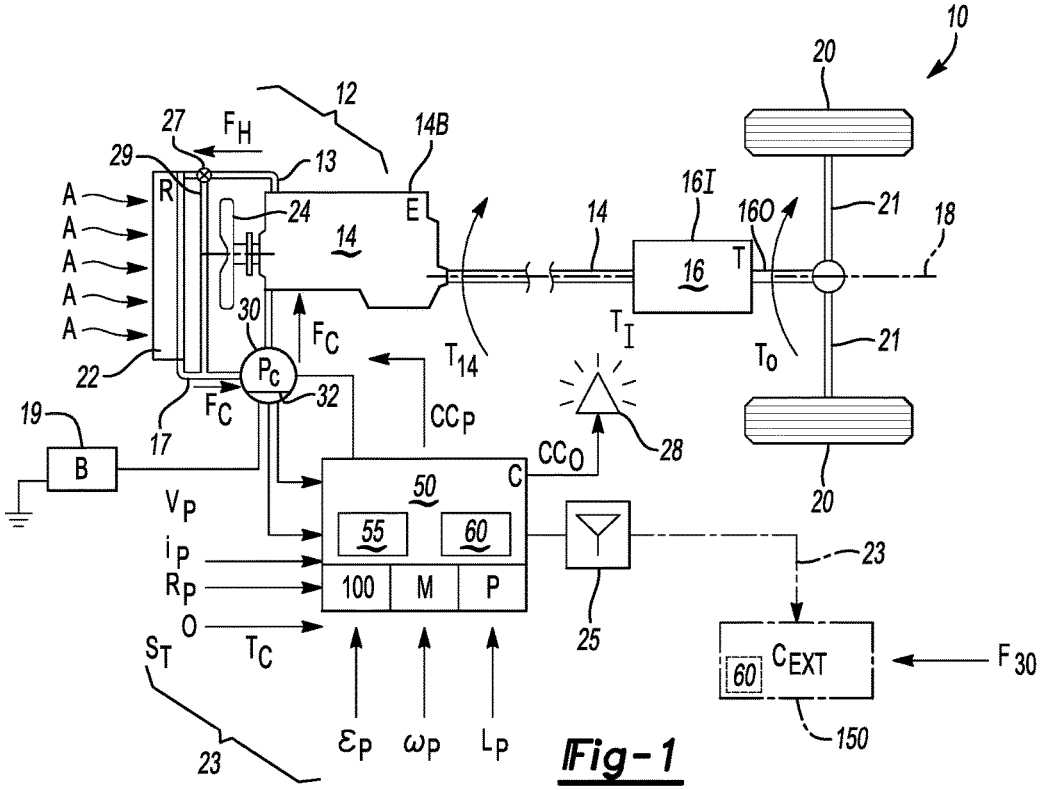
FIG. 1 is a schematic perspective view illustration of an example vehicle having a thermal management system with component-level and system-level numeric states of health determined as set forth herein.

Referring to the drawings, wherein like reference numbers refer to like components, FIG. 1 provides a schematic view illustration of a vehicle 10 having a thermal management system 12 that is operable for regulating a temperature of a heat source, shown as an example internal combustion engine (E) 14 having an engine block 14B. In operation, the engine 14 provides engine torque (arrow $T_{14}$) to a transmission (T) 16 arranged on a driveline 18 along with the engine 14, with the engine 14 and transmission 16 coupled to each other via a hydrodynamic torque converter or an input clutch (not shown). An input member 161 of the transmission 16 is thus supplied with an input torque (arrow $T_I$) that may be selectively assisted as needed by an electric motor (not shown) in optional hybrid embodiments. Within the transmission 16, one or more gear sets and additional clutches (not shown) transfer the input torque (arrow $T_I$) to an output member 160 to thereby deliver an output torque (arrow $T_O$) to a set of drive wheels 20 via one or more drive axles 21.

The thermal management system 12 includes an electrically-driven coolant pump ($P_C$) 30. The coolant pump 30 is in fluid communication with a radiator (R) 22 via inlet and outlet coolant hoses 13 and 17, with ambient air (arrows A) drawn into the radiator 22 via operation of a cooling fan 24. Heated coolant (arrow $F_H$) such as antifreeze or water is circulated from the engine block 14B into the radiator 22 through the inlet coolant hose 13, while cooled coolant (arrow $F_C$) is fed back to the coolant pump 30 via the outlet coolant hose 17. A rotary valve 27 is controlled to distribute coolant flow to the radiator 22 based on coolant temperature (arrow $T_C$). That is, when the engine 14 is hot, more coolant flows to the radiator 22 via operation of the valve 27. Similarly, when the engine 14 is relatively cool, more coolant is allowed to bypass the radiator 22 via a bypass branch 29 to allow the engine 14 to heat up faster.

The coolant pump 30 includes a plurality of pump sensors 32 operable for measuring or otherwise determining a corresponding pump voltage ($V_p$), pump speed ($\omega_P$), and a pump current ($i_P$). With respect to pump speed, the pump sensors 32 may be configured to report a position/speed signal, e.g., via controller area network (CAN) bus messaging or other low-voltage signal transmission. The pump motor may be optionally embodied as an AC motor or a brushless DC motor, with a resident motor control processor of the coolant pump 32 or a separate controller determining pump speed ($\omega_P$) based on the measured pump voltage ($V_p$) and pump current ($i_P$). For example, a position of a rotor of the coolant pump 30 may be measured via a resolver or encoder, with the rate of change of the measured position corresponding to the pump speed ($\omega_P$), or pump phase currents and voltages may be used to calculate a corresponding speed, e.g., using a calibrated relationship as is known in the art.

The thermal management system 12 also includes a power source 19, e.g., a battery (B), that is electrically connected to the coolant pump 30, and that energizes operation of the coolant pump 30 and the pump sensors 32. As the coolant pump 30 is electrically driven, a controller (C) 50, such as an engine control module, is placed in communication with the coolant pump 30 and the pump sensors 32 to control the rotational speed of blades (not shown) of the coolant pump 30. Speed control may be achieved using pump control signals (arrow $CC_P$) independently of engine speed, with the coolant pump 30 thereby acting as a smart actuator within the thermal management system 12 as noted elsewhere above.

As will be explained in further detail below with particular reference to FIGS. 2-6, the controller 50 of FIG. 1 is programmed to receive electrical signals 23 from the coolant pump 30, including the measured pump voltage (arrow $V_P$), pump speed (arrow $\omega_P$), and pump current (arrow $i_P$) from the pump sensors 32 and a coolant temperature (arrow $T_C$) from one or more temperature sensors ($S_T$) positioned in the coolant flow and/or the engine 14. The controller 50 also receives or calculates a flow restriction factor based on thermostat position or rotary valve position. The controller is configured to classify a numeric state of health (SOH) of the coolant pump 30 across multiple different operating regions of the coolant pump 30 using the received pump voltage and current (arrows $V_P$ and $i_P$).

As part of its intended operating function, the controller 50 may be programmed to store a calibrated baseline relationship 55 between pump speed and pump power draw using a non-linear or logarithmic scale, a non-limiting example of which is described below with reference to FIG. 4B. The controller 50 may further detect a steady-state operating condition of the coolant pump 30, monitor pump speed and power draw of the coolant pump 30, and estimate an operational relationship between pump speed and power draw in real-time.

Using this collected information, the controller 50 may detect the presence of a coolant leak and/or an obstruction of coolant flow based on a deviation between the calibrated baseline relationship 55 and the actual operational relationship. Additionally, the controller 50 is specially configured to calculate a numeric state of health (SOH) of the thermal management system 12 for each pump operating region, and to ultimately execute a control action with respect to the system 12, including identifying the numeric SOH of multiple pump performance characteristics. This is done doing so prior to setting a diagnostic fault code or trouble code indicative of an actual/hard failure of the thermal management system 12 or a component thereof.

That is, when the calculated numeric SOH for a given operating region is less than a calibrated SOH threshold for that region, e.g., 50% of a calibrated new/properly functioning SOH, the numeric SOH may be reported to the operator of the thermal management system 12, thus providing the operator with ample warning and allowing the operator to preemptively service an impending or slowly developing failure before a total failure occurs. An indicator device 28 such as a message light or text message screen responsive to output signals (arrow $CC_O$) from the controller 50 may be used to alert an operator to the numeric SOH.

Optionally, the numeric SOH may be determined partially or fully offline/offboard using an external controller ($C_{EXT}$) 150. The external controller 150 may be placed in remote communication with the controller 50 via a telematics unit 25, e.g., a transceiver/transponder, antenna, or cellular device, and thus may be located a substantial distance away from the thermal management system 12. Telematics signals (arrow TT) may be transmitted to the external controller 150. Use of the external controller 150 may enable the external controller 150 to utilize similar data from other thermal management systems 12 deployed, for instance, across a fleet of vehicles 10, and/or to readily update any programmed baseline calibrations across such a fleet.

The controller 50 and the optional external controller 150 may be embodied as one or more computer devices. While omitted from the controller 150 for illustrative simplicity, the controllers 50 and 150 are equipped with the requisite memory (M) and a processor (P), as well as associated hardware and software, e.g., a clock or timer, input/output circuitry, etc. Memory (M) includes sufficient amounts of read only memory, for instance magnetic or optical memory, on which is recorded computer-readable instructions 100 embodying the processes described herein.

The controller 50 and/or the external controller 150 execute the instructions 100 via pump prognosis logic 60 to generate the numeric SOH of the thermal management system 12, with identification of the particular developing failure mode, e.g., a fluid leak, a worn or defective bearing, or a pump motor electrical failure. Independently of the forward-looking SOH function of the controller 50 or 150, the controller 50 may also receive a detected fault (arrow $F_{30}$) indicative of an actual (i.e., not impending or developing) hard fault or failure of the coolant pump 30 as part of the ongoing operating function of the controller 50, with the coolant pump 30 possibly reporting such faults as part of a programmed self-diagnosing functionality. By way of example, the pump voltage ($V_P$) may fall outside of a calibrated allowable voltage range indicative of a short circuit or open circuit condition, or an overcurrent or undercurrent condition may be detected, or the temperature of the engine 14 may rise above a maximum allowable temperature, any of which may trigger generation of the detected fault (arrow $F_{30}$).

As part of the thermal management system 12 of FIG. 1, the controller 50 and/or 150 may also be programmed with a nominal resistance, inductance, and efficiency values for the coolant pump 30, which may be stored memory (M) and accessed by the processor (P) as needed. The controller 50 is also operable for estimating a pump resistance ($R_P$), a pump inductance ($L_P$), and a pump efficiency ($\varepsilon_P$) for the coolant pump 30 in real time, e.g., using modeling or calculation as is known in the art. The controller 50 and/or 150 then classifies the performance of the coolant pump 30 across each of the multiple different pump operating regions using a difference between the nominal and estimated values.

Figure 2:
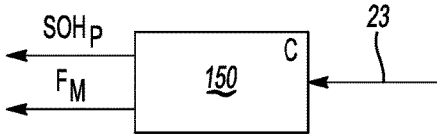
FIG. 2 is a schematic flow diagram describing operation of a controller usable with the thermal management system of FIG. 1.

Referring to FIG. 2, the external controller ($C_{EXT}$) 150 is shown in schematic form to depict a possible logic flow downstream of the telematics unit 25 of FIG. 1. The telematics data (arrow TT) may be transmitted by the telematics unit 25 to the external controller 150. In other embodiments, the controller 50 of FIG. 1 may be configured to perform the functions of the controller 150 as noted above. As is known in the art, the vehicle 10 of FIG. 1 may, from upstream of the telematics unit 25, perform digital signal processing functions such as filtering of signal noise from the received raw pump voltage and current signals (arrows $V_P$, $i_P$ of FIG. 1), e.g., using high-pass, low-pass, and/or bandpass filtering. Steady-state features may be extracted from the filtered data, with the extracted features stored in memory (M) of the controller 50 and/or 150 and updated over time.

Example features may include a calculated power and speed of the coolant pump 30 as shown with the calibrated baseline relationship in FIG. 4B and explained below. Periodically, the extracted features may be transmitted as the telematics data (arrow TT) to the external controller 150 via the telematics unit 25, e.g., after a key-off event in which an ignition of the vehicle 10 is turned off. The external controller 150, or in other embodiments the controller 50 located aboard the vehicle 10, may then process the extracted features via the pump prognosis logic 60 to determine, as separate output signals, a numeric SOH (arrow $SOH_P$) and a corresponding failure mode (arrow FM) of the coolant pump 30.

Figure 3:
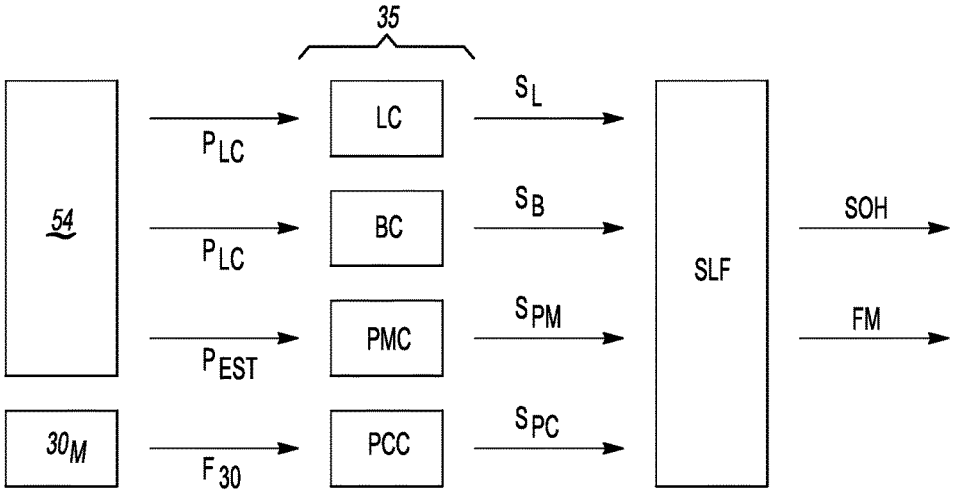
FIG. 3 is a schematic flow diagram describing a controller-based process of performing state of health prognosis of the example thermal management system shown in FIG. 1.

FIG. 3 depicts a schematic flow diagram describing a controller-based process of performing the present numeric SOH prognosis of the thermal management system 12 in FIG. 1. As part of the overall process embodied by the instructions 100 of FIG. 1, the pump prognosis logic 60 of the controller 50 and/or 150 performs individual component level checks 35, including each of a leak check (LC), a bearing check (BC), a pump motor check (PMC), and a pump circuit check (PCC), with the leak and bearing checks (LC and BC) described in further detail below with reference to FIG. 4A and the pump motor check (PMC) described in further detail with reference to FIG. 5. A system-level fusion (SLF) is then performed as described below with reference to FIG. 6 in order to diagnose a numeric SOH of the thermal management system 12 as a whole. Thus, the blocks labeled LC, BC, PMC, PCC, and SLF represent programmed software blocks of the controller 50 and/or 150, which may be executed using associated hardware components of the controller 50 and/or 150.

As part of the ongoing function of the controller 50, e.g., onboard pump prognostic functions in an engine control module embodiment of the controller 50, certain diagnostic values may be estimated, including an estimated pump load curve (arrow $P_{LC}$) and estimated pump motor parameters (arrow $P_{EST}$), e.g., motor resistance or inductance, which may vary with the level of degradation due to oxidation, demagnetization, etc., of the pump motor. Additionally, the fault statuses (arrow $F_{30}$) shown schematically in FIG. 1 may be reported to the controller 50, e.g., by logic or a motor control processor $\mathbf{30}_M$ of the coolant pump 30. The individual component-level checks 35 are then performed as the above-noted leak check (LC), bearing check (BC), pump motor check (PMC), and pump circuit check (PCC). As outputs from the various component-level checks 35, quantitative values are output to quantify the level of degradation or severity of different pump characteristics, including leaking/clogging status (arrow $S_L$), pump bearing status (arrow $S_B$), pump motor status (arrow $S_{PM}$), and pump circuit status (arrow $S_{PC}$). The system-level fusion (SLF) is then performed using the output from the various determined component-level checks 35, with a numeric SOH (arrow SOH) and system failure mode (arrow FM) ultimately generated as outputs.

FIG. 4A depicts process flow for the leak and bearing checks shown schematically in FIG. 3. As part of the required configuration, the controller 50 is programmed to perform multi-region classification (MRC) of performance of the coolant pump 30 using received pump loading data (PLD), and to determine the pump motor health (PMH) using such classifications. More specifically as to the pump loading data, the coolant pump 30 may behave differently at different operating conditions such as different temperatures and different plumbing flow restrictions due to the position of the thermostat or rotary valve for flow direction regulation, and therefore the controller 50 may be programmed to individually classify the performance and numeric SOH of the coolant pump 30 for each of an integer plurality (j) of different pump operating regions, with treatment of such regions represented as classifiers C1, C2, . . . , Cj in FIG. 4A.

Schematically, each pump operating region has a corresponding regional classifier, with the term "classifier" referring to programmed classification functionality as set forth below. Thus, the numeric SOH may be determined separately for each pump operating region, i.e., $SOH_1$, $SOH_2$, . . . , SOHj. The controller 50 may thereafter fuse the results of the different classifications using a weighted filtering ($F_W$) block, such as by assigning numeric weights to each classifier to capture the relative significance or impact thereof on the overall health of the thermal management system 12. A final fault severity estimate (arrow FSE) is then output from the controller 50 as a numeric value, e.g., a percentage value or an integer representing a relative severity, which may be part of the output signals (arrow $CC_O$) shown in FIG. 1.

For instance, as shown by way of example in FIG. 4B, the controller 50 may calculate various bearing fault (BF), nominal (NOM), and leak fault (LF) traces on a logarithm scale, e.g., with the log of pump power (Log $P_P$) plotted on the Y axis and the log of pump speed (Log $N_P$) plotted on the X axis. The nominal trace corresponds to the calibrated baseline noted above. The power-speed relationship for a closed fluid circuit may be characterized as $P_P=\alpha N_P^{\beta}$, where $P_P$ is the power supplied to the coolant pump 30 and $N_P$ is the rotational speed of the coolant pump 30. The variables $\alpha$ and $\beta$ are system constants which relate to flow characteristics of the thermal management system 12. Transforming the above equation from a linear scale to a logarithmic scale allows the power-speed relationship of the coolant pump 30 to be represented as a linear relationship. This may be useful because the system constants $\alpha$ and $\beta$ correspond to offset and slope of the linear curve, and thus can be used to characterize a coolant flow resistance function. The linear relationship between pump power ($P_P$) and the pump speed ($N_P$) present in the logarithm domain may be represented as:

$$\log(P_P)=\log(\alpha)+\beta\ \log(N_P)$$

The nominal trace (NOM) of FIG. 4B may be recorded as a reference value corresponding to performance of a normal/healthy/new coolant pump 30. Leaking coolant tends to decrease pump power, while a bearing fault tends to increase pump power. Thus, the use of linear local classifiers (C1, C2, . . . , Cj) of FIG. 4A provides a straightforward way to calibrate and implement the present approach. As pump performance changes relative to the nominal (NOM) trace of FIG. 4B, as indicated by arrows AA and BB, the controller 50 can ascertain whether, for the particular pump operating region being considered, the reported data is indicative of a developing bearing fault or leak fault. In other words, an increasing deviation from the nominal trace (NOM) of FIG. 4B may be treated as being more indicative of a particular type of developing fault, e.g., a particular portion of leaked coolant or a particular percentage of worn bearings, without the fault having yet materialized into an actual hard fault potentially preventing further operation of the engine 14 of FIG. 1. This enables look-ahead/preemptive consideration of the developing fault mode.

FIG. 5 depicts an approach for handling the pump motor health diagnostic logic flow shown in the logic block labeled PMC in FIG. 3. A motor condition estimation (MCE) logic block receives calculated electrical parameters 58 and generates a pump motor health condition (arrow PMC) indicative of or as the numeric SOH of the coolant pump 30 of FIG. 1. Motor parameters such as pump resistance, inductance, back-emf, and efficiency may be estimated from sensor measurements such as speed, current, voltage using calibrated pump equations, and compared to calibrated nominal values for a healthy/new coolant pump 30. Residual values are then calculated as represented in FIG. 5 by the delta ($\Delta$) function, i.e., the resistance residual $\Delta R=(R_{EST}-R_{NOM})$, with the subscript "EST" and "NOM" referring to estimated and nominal values, respectively. Similarly, the controller 50 calculates the inductance residual $\Delta L=(L_{EST}-L_{NOM})$ and the motor efficiency residual $\Delta\varepsilon=(\varepsilon_{EST}-\varepsilon_{NOM})$. The controller 50 may also examine the status signals, such as the measured (MEAS) voltage and current under a particular operating speed, and compare those with nominal values to calculate the voltage residual $\Delta V=(V_{\backslash MEAS}-V_{NOM})$ and the motor current residual $\Delta i=(i_{MEAS}-i_{NOM})$. The MCE logic block of FIG. 5 may be embodied as logic performing a calibrated averaging function on the various residuals to estimate motor health condition.

By way of illustration and not limitation, an example of such a function may be represented as follows:

$$\text{Numeric } SOH = Ave\left(\frac{R-\Delta R}{R}\cdot\frac{L-\Delta L}{L}\cdot\frac{\varepsilon-\Delta\varepsilon}{\varepsilon}\cdot\frac{V-\Delta V}{V}\cdot\frac{i-\Delta i}{i}\right).$$

with R, L, $\varepsilon$, V, and i being measured or calculated actual values, and the residuals being absolute values of between 0 and 1, e.g., $|\Delta R|<1$.

FIG. 6 depicts a possible embodiment of a lookup table 55, i.e., a decision table, for use in system-level fusion of the above-described process, as the individual faults may be correlated as set forth herein. Using the individual component-level diagnostics described with reference to FIGS. 3-5, the controller 50 may populate columns of the lookup table 55, which may be organized in corresponding to circuit status (CS), leaking status (LS), bearing status (BS), pump motor status (PMC), and a final result (RES). A correlation to the final result (RES) may be determined offline for each possible pump status mode. For each column, a corresponding faulty (F), healthy (H), or undetermined/not required (*) value is then entered in response to the component-level SOH diagnostics described above. The controller 50 may be programmed with the corresponding final result (RES), e.g., a faulty circuit (FC) may be present when a circuit fault is detected in a sensor circuit, i.e., a sensor is no longer reading properly so its values are invalid. Thus, the notation "*" may be treated as being indicative of the faulty/healthy status being irrelevant to the determination of the result.

Similarly, for pump characteristics in which the pump sensors 32 are healthy and thus functioning properly, a faulty motor of the coolant pump 30 of FIG. 1 may correspond to a pump motor fault (FM). When such a pump motor is deemed healthy but a faulty leak status and a faulty bearing status are indicated, the results may be inconclusive (INC). A leak fault (FL) may be indicated for the thermal management system 12 of FIG. 1 when the bearing status is healthy and the leaking status is faulty, regardless of pump motor status, while a bearing fault may be indicated when the bearing status is healthy, the leak status is faulty, and the pump motor status is healthy. The controller 50 may be programmed to diagnose more than one system fault, e.g., a motor fault and a leaking fault may occur at the same time. Thus, the lookup table 55 may be used by the controller 50 to rapidly identify the root cause of the impending failure.

Using the above-described approach, a numeric SOH of the thermal management system 12 of FIG. 1 may be determined as a means of predicting the amount of remaining useful life of a given system component and/or the system 12 as a whole. That is, processor functionality may be programmed into the controller 50 and/or 150 as the instructions 100 shown in FIG. 1 to implement a prognostic method for the electric coolant pump 30. Such a method could include receiving, via the controller 50 and/or 150, the measured voltage and current (arrows $V_P$, $i_P$) from the pump sensors 32 of FIG. 1, then determining a level of performance of the coolant pump 30 across multiple pump operating regions using the received information. The controller 50 and/or 150 could then calculate the numeric SOH to quantify a relative severity of degradation each of the pump characteristics noted above, doing so across multiple pump operating regions. Either controller 50 or 150 may thereafter execute a control action with respect to the thermal management system 12 of FIG. 1, e.g., when the calculated numeric SOH for a respective one of the pump operating regions is less than a calibrated SOH threshold.

The disclosed approach allows for the indication of slowly-developing failures before such failures are actually realized. The present method lends itself to electrical devices such as the electric coolant pump 30 of FIG. 1 due to the availability of electrical parameters, whose changes relative to nominal values may be considered systematically at different temperatures or speeds to accurately ascertain the SOH.

The detailed description and the drawings or figures are supportive and descriptive of the disclosure, but the inventive scope is defined solely by the claims. While some of the best modes and other embodiments for carrying out the disclosure have been described in detail herein, various alternative designs and embodiments exist. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

What is claimed is:

1. A thermal management system comprising:

an electric coolant pump in fluid communication with a heat source and a radiator, and having a plurality of pump sensors operable for determining a voltage, a speed, and a current of the coolant pump;

a power source that is electrically connected to the coolant pump and operable for energizing the coolant pump and the pump sensors; and controller in communication with the coolant pump and the pump sensors, and programmed to receive the voltage, speed, and current from the pump sensors, determine a level of performance of the coolant pump across multiple pump operating regions using the received voltage and current, calculate a numeric state of health (SOH) quantifying a degradation severity for each of a plurality of pump characteristics across the pump operating regions, and execute a control action with respect to the thermal management system when the calculated numeric SOH for any of the pump operating regions is less than a calibrated SOH threshold;

wherein the pump characteristics include a pump leaking/clogging status, a pump bearing status, a pump motor status, and a pump circuit status.

2. The thermal management system of claim 1, wherein the controller is programmed with a nominal resistance and a nominal inductance value of the coolant pump, is configured to estimate a resistance and an inductance value for the coolant pump, and is further configured to classify the performance of the coolant pump across the multiple pump operating regions using respective differences between the nominal and estimated resistance values and the nominal and estimated inductance values.

3. The thermal management system of claim 1, wherein the multiple pump operating regions include different rotational speeds of the coolant pump and different temperatures of a coolant circulated via the coolant pump.

4. The thermal management system of claim 1, wherein the controller is programmed with a calibrated baseline relationship between a rotational speed of the coolant pump and a power draw of the coolant pump, and to calculate the numeric SOH using a deviation of an actual or modeled performance of the calibrated baseline relationship from the calibrated baseline relationship.

5. The thermal management system of claim 1, wherein the controller includes a first controller programmed to receive the measured voltage and current from the pump sensors, determine the level of performance of the coolant pump across the multiple pump operating regions, and execute the control action, and a second controller configured to calculate the numeric SOHs of the thermal management system, the system further comprising a telematics unit, wherein the first and second controllers are in remote communication with each other via the telematics unit.

6. The thermal management system of claim 1, wherein the controller is programmed to apply a weighted filter to the calculated numeric SOHs to determine an overall numeric SOH of the thermal management system.

7. A vehicle comprising: a heat source; a radiator; and thermal management system having: an electric coolant pump in fluid communication with the heat source and the radiator, and operable for circulating coolant through the heat source and radiator, the coolant pump having a plurality of pump sensors operable for measuring a voltage and a current of the coolant pump; a battery electrically connected to the coolant pump and operable for energizing the coolant pump and the pump sensors; and controller in communication with the coolant pump and the pump sensors, and programmed to receive the measured voltage and current from the pump sensors, determine a level of performance of the coolant pump across multiple pump operating regions using the received voltage and current, calculate a numeric state of health (SOH) of the thermal management system quantifying a relative severity of each of a plurality of pump characteristics across the pump operating regions, and execute a control action with respect to the thermal management system when the calculated numeric SOH for any of the pump operating regions is less than a calibrated SOH threshold; wherein the pump characteristics include a pump leaking/clogging status, a pump bearing status, a pump motor status, and a pump circuit status.

8. The vehicle of claim 7, wherein the heat source is an internal combustion engine.

9. The vehicle of claim 7, wherein the controller is programmed with nominal resistance and inductance values for the coolant pump, is configured to estimate resistance and inductance values for the coolant pump, and is further configured to classify the performance of the coolant pump across the multiple pump operating regions using respective differences between the nominal and estimated resistance values and the nominal and estimated inductance values.

10. The vehicle of claim 7, wherein the multiple pump operating regions include different rotational speeds of the coolant pump and different temperatures of a coolant circulated via the coolant pump.

11. The vehicle of claim 7, wherein the controller is programmed with a calibrated baseline relationship between a rotational speed of the coolant pump and a power draw of the coolant pump, and for calculating the numeric SOH using a deviation of an actual or modeled performance of the calibrated baseline relationship from the calibrated baseline relationship.

12. The vehicle of claim 7, wherein the controller includes a first controller programmed to receive the measured voltage and current from the pump sensors, determine the level of performance of the coolant pump across the multiple pump operating regions, and execute the control action, and a second controller configured to calculate the numeric SOHs of the thermal management system, the system further comprising a telematics unit, wherein the first and second controllers are in remote communication with each other via the telematics unit.

13. The vehicle of claim 7, wherein the controller is programmed to apply a weighted filter to the plurality of pump statuses to determine an overall numeric SOH of the thermal management system.

14. A prognostic method for an electric coolant pump in a vehicle having an internal combustion engine, an electric coolant pump, and a radiator, the method comprising: receiving, via a controller, a measured voltage and current from a plurality of pump sensors of the coolant pump; determining a level of performance of the coolant pump across multiple pump operating regions using the received voltage and current; calculating a numeric state of health (SOH) of the thermal management system that quantifies a relative severity of degradation for each of a plurality of pump characteristics across multiple pump operating regions; and executing a control action with respect to the thermal management system via the controller when the calculated numeric SOH for any of the pump operating regions is less than a calibrated SOH threshold, wherein the pump characteristics include a pump leaking/clogging status, a pump bearing status, a pump motor status, and a pump circuit status.

15. The method of claim 14, further comprising estimating resistance and inductance values for the coolant pump, wherein classifying the performance of the coolant pump across the multiple pump operating regions includes using respective differences between nominal and the estimated resistance values and nominal and the estimated inductance values.

16. The method of claim 14, wherein the multiple pump operating regions include different rotational speeds of the coolant pump and different temperatures of a coolant circulated via the coolant pump.

17. The method of claim 14, wherein the controller is programmed with a calibrated baseline relationship between a rotational speed of the coolant pump and a power draw of the coolant pump, further comprising calculating the numeric SOH using a deviation from a calibrated baseline relationship of an actual or modeled performance of relationship between a rotational speed of the coolant pump and a power draw of the coolant pump.

18. The method of claim 14, the controller including first and second controllers, the vehicle including a telematics system, the method further comprising communicating the level of performance of the coolant pump across the multiple pump operating regions from the first controller to the second controller using the telematics unit, and calculating the numeric SOHs of the thermal management system using the second controller.

19. The method of claim 14, further comprising applying a weighted filter to each numeric SOH to determine an overall numeric SOH of the thermal management system.

* * * * *